US005857654A

United States Patent [19]

Berman

[11] Patent Number: 5,857,654

[45] Date of Patent: Jan. 12, 1999

[54] DOCUMENT STAND

[76] Inventor: Richard W. Berman, 75 Windom St., White Plains, N.Y. 10607

[21] Appl. No.: 781,348

[22] Filed: Jan. 21, 1997

[51] Int. Cl.[6] ..... A47B 19/00

[52] U.S. Cl. ..... 248/441.1; 40/606; 248/450

[58] Field of Search ..... 248/441.1, 442.2, 248/450; 40/606, 764, 738

[56] References Cited

U.S. PATENT DOCUMENTS

| | | | |
|---|---|---|---|
| 1,681,586 | 8/1928 | Kessler | 248/441.1 X |
| 3,779,504 | 12/1973 | Schwartz et al. | 248/441.1 |
| 4,125,243 | 11/1978 | Liptak | 40/764 X |
| 5,505,421 | 4/1996 | Marthaler | 248/918 |
| 5,775,663 | 7/1998 | Fitzsimmons et al. | 248/450 |

*Primary Examiner*—Ramon O. Ramirez

[57] ABSTRACT

A document stand to support paper (or other flexible sheet material) for use as a copy holder while typing or for use to display graphic matter. Using a form with a bent slot on the device's top surface, it allows the bottom edge of either a single or multiple sheets of paper to fit into it. The slot engages the paper in an arc which allows the paper to use its own inherent strength to support itself in an upright position. The flexible paper conforms to this slightly curved shape of the slot allowing it to remain upright without additional rear, side or top supports. This upright position of the paper is tilted slightly back to both increase stability and ease of viewing of the document.

4 Claims, 6 Drawing Sheets

DOCUMENT STAND

TECHNICAL FIELD

The present invention fits within Class 248—Supports. This class covers devices that hold articles steady against the pull of gravity. Devices are described that support paper or other sheet material for viewing in an upright or inclined position.

BACKGROUND INFORMATION

Document stands typically use one of several types of support systems for the displayed sheet material. One type typically uses both base and rear supports against which the sheets can rest flatly, in an inclined position. This easel type of document stand is relatively bulky and takes up substantial desk space, both horizontally and vertically. The rear support upon which the sheets recline generally covers most or all of the length and width of the sheets.

Another type of document stand uses a top support from which it can clip the top of the sheets and hang them vertically. Though it may take up less desk space than the easel type device, it is often unsightly and generally requires two hands free to clip and un-clip sheets for viewing. When used as a copy holder for documents in an activity such as typing on a computer keyboard while viewing a monitor, it requires removing both hands from the keyboard in order to clip or un-clip a sheet. This forces the user to glance downwards and away from the documents while repositioning both hands back onto the keyboard.

SUMMARY OF THE INVENTION

A document stand to support paper (or other flexible sheet material) for use as a copy holder while typing or for use to display graphic matter. Using a form with a bent slot along the device's top surface, it allows the bottom edge of either a single or multiple sheets of paper to fit into it. The slot engages the paper in an arc which allows the paper to use its own inherent strength to support itself in an upright position. The flexible paper conforms to this slightly curved shape of the slot allowing it to remain upright without additional rear, side or top supports. This upright position of the paper is tilted slightly back to both increase stability and ease of viewing of the document.

A typical use of this invention would be as a copy holder used within a computer environment. It would be placed on the desktop, alongside the computer monitor. Retyping edited or handwritten material into the computer, the typist would use the invention to support the printed sheets in an inclined position. A typical copy holder eases the transition between viewing the computer screen and paper documents by placing the documents in a generally upright manner adjacent to the computer screen. This invention does this as well.

In addition this device allows the insertion or removal of documents to be accomplished with one hand if desired. Therefore the typist is not required to reposition both hands and subsequently glance down and away from the monitor and documents as with a top clipping device. There is no bulky raised rear support as with an easel. There is only a small, low object that the sheets slip into, taking up little desk space. The realigned shape of the inserted sheets braced within the slot allows the paper to remain upright with a slight incline and without the use of any supports above the bottom edge of the paper.

Other uses of this invention might include the display of graphic material such as photos, signage, notes, calendars, etc. that need to be in view for longer periods of time.

DESCRIPTION OF THE PREFERRED EMBODIMENTS

Figure 1:
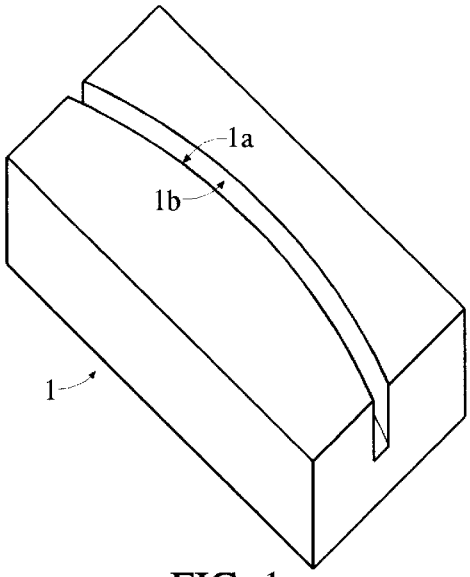
FIG. 1 is a perspective view of the first preferred embodiment of the document stand.

In describing the preferred embodiments of the invention, which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

The term paper has been used herein as the generic term to describe any thin flexible sheet material.

Six embodiments of the document stand are illustrated. They are shown to demonstrate the diversity of forms the sheet support mechanism and document stand as a whole can take to support paper in an inclined position. The mechanism is effectively a bent slot within which the base of the paper will be fitted. The effective surfaces of the slot are those that come into contact with and serve to brace the inserted paper in an inclined and stable position. These effective surfaces occur along what will herein be defined as the inner face of the slot, the outer face of the slot, and the lower face of the slot.

Figure 2:
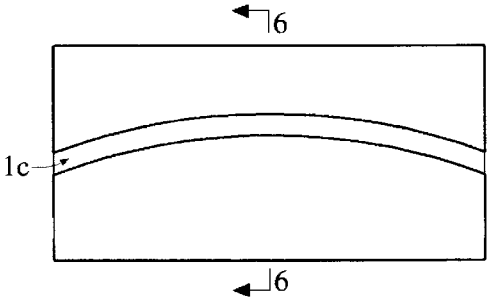
FIG. 2 is a top view of the first preferred embodiment of the document stand.
Figure 3:
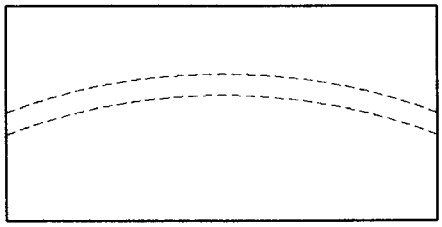
FIG. 3 is a bottom view of the first preferred embodiment of the document stand.
Figure 4:
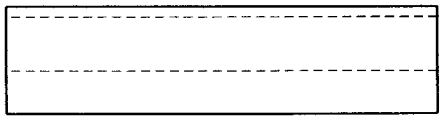
FIG. 4 is a front elevation of the first preferred embodiment of the document stand.
Figure 5:
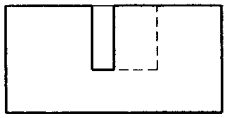
FIG. 5 is a side elevation of the first preferred embodiment of the document stand.
Figure 6:
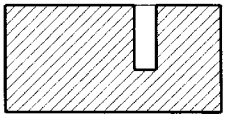
FIG. 6 is a section view of the first preferred embodiment of the document stand.
Figure 7:
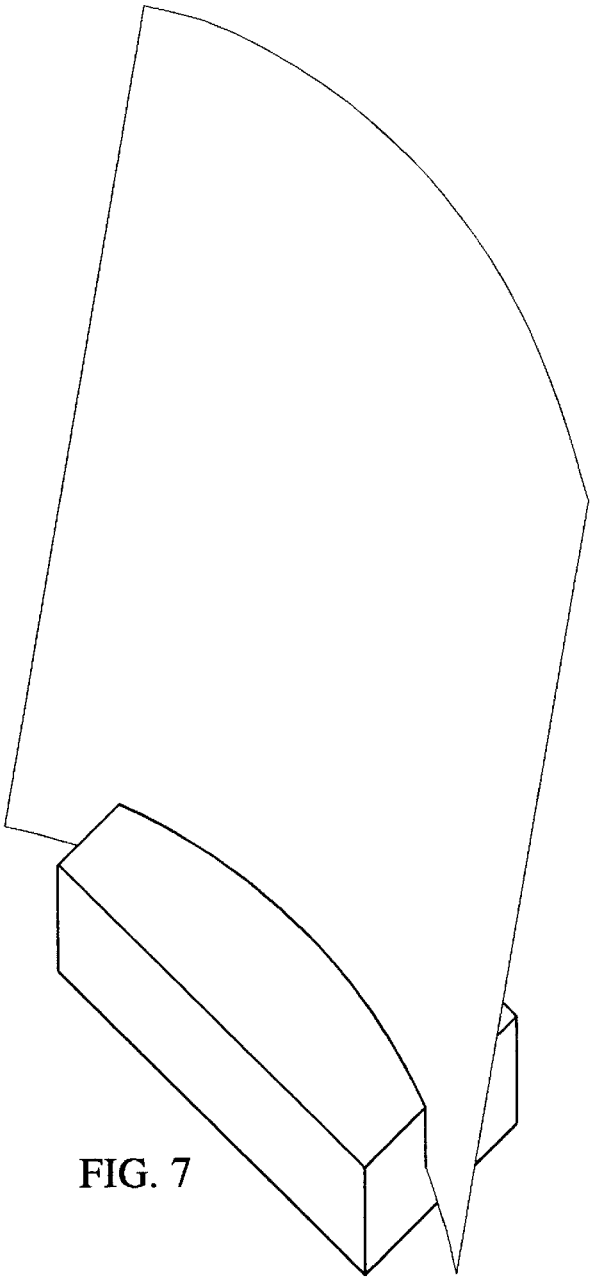
FIG. 7 is a perspective view with paper inserted, of the first preferred embodiment of the document stand.

Referring to FIG. 1 through FIG. 7, the first preferred embodiment of the document stand is illustrated. The document stand is comprised of component 1 which serves as the base of the document stand and contains the effective sheet support mechanism within it. The sheet support mechanism is created through slot inner face 1*a*, slot outer face 1*b*, and slot lower face 1*c*. Slot inner face 1*a* and slot outer face 1*b* take on a similarly gently curved form in this embodiment. Slot lower face 1*c* is a flat, horizontal, continuous surface.

The bottom edge of the paper is flexed as required to fit into and conform to the bent shape of the device's slot. The placement of the paper will be such that the top tilts away from the viewer slightly. The paper will then be braced and held in place in a semi-rigid form that allows it to remain stable and hold its shape in this inclined position. The new shape and orientation of the inserted paper causes the central portion of the bottom edge of the paper to lie vertically beneath the level of the bottom corners of the paper. This lowest portion of the inserted paper will abut slot lower face 1*c* at a single point only, preferably at a location near the center of the bottom edge of the inserted paper.

There will be a tendency for the document stand to tilt backwards due to the cantilevering of the paper beyond the rear most point of contact of component 1 against the horizontal surface on which is sits. The weight of the material chosen for component 1 therefore must be sufficient to counterbalance this tendency. The texture of slot inner face 1*a* and slot outer face 1*b* must create sufficient friction to offset the tendency of the base of the inserted paper to slide up and out of the slot.

Figure 8:
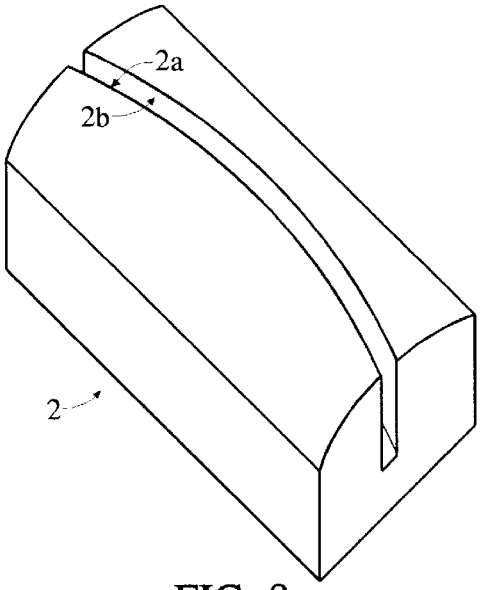
FIG. 8 is a perspective view of the second preferred embodiment of the document stand.
Figure 9:
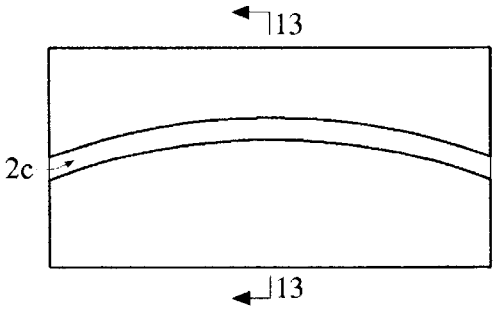
FIG. 9 is a top view of the second preferred embodiment of the document stand.
Figure 10:
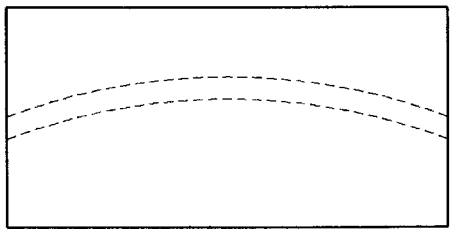
FIG. 10 is a bottom view of the second preferred embodiment of the document stand.
Figure 11:
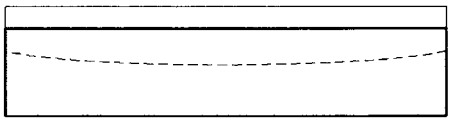
FIG. 11 is a front elevation of the second preferred embodiment of the document stand.
Figure 14:
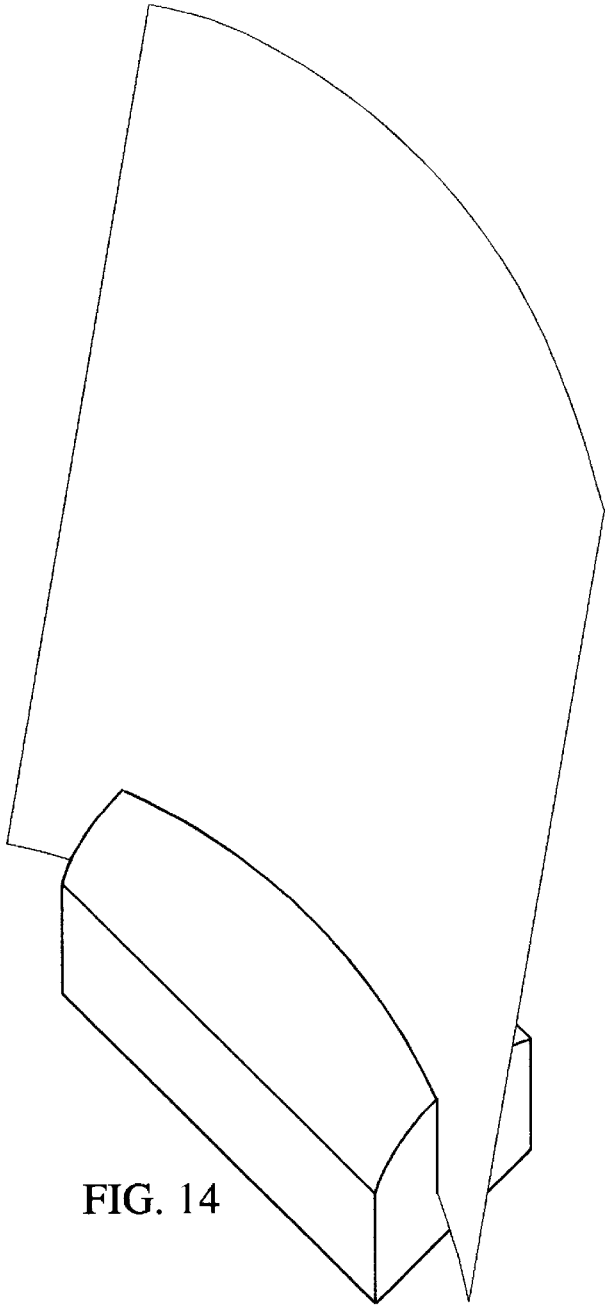
FIG. 14 is a perspective view with paper inserted, of the second preferred embodiment of the document stand.
Figure 12:
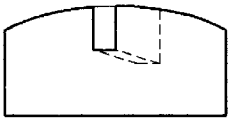
FIG. 12 is a side elevation of the second preferred embodiment of the document stand.
Figure 13:
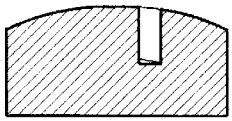
FIG. 13 is a section view of the second preferred embodiment of the document stand.

Referring to FIG. 8 through FIG. 14, the second preferred embodiment of the document stand is illustrated. The document stand is comprised of component 2 which serves as the base of the document stand and contains the effective sheet support mechanism within it. The sheet support mechanism is created through slot inner face 2*a*, slot outer face 2*b*, and slot lower face 2*c*. Slot inner face 2*a* and slot outer face 2*b* take on a similarly gently curved form in this embodiment. Slot lower face 1*c* is a continuous, vertically concave surface, deeper in the center than the ends. The bottom edge of the paper is flexed as required to fit into and conform to the bent shape of the device's slot. The placement of the paper will be such that the top tilts away from the viewer slightly. The paper will then be braced and held in place in a semi-rigid form that allows it to remain stable and hold its shape in this inclined position. The new shape and orientation of the inserted paper causes the central portion of the bottom edge of the paper to lie vertically beneath the level of the bottom corners of the paper. The vertically concave shape of slot lower face 2*c* follows the depth of the bottom edge of the inserted paper. This bottom edge of the inserted paper will abut slot lower face 2*c* continuously along its length. The top surface of component 2 is curved in this embodiment.

There will be a tendency for the document stand to tilt backwards due to the cantilevering of the paper beyond the rear most point of contact of component 2 against the horizontal surface on which it sits. The weight of the material chosen for component 2 therefore must be sufficient to counterbalance this tendency. The texture of slot inner face 2*a* and slot outer face 2*b* must create sufficient friction to offset the tendency of the base of the inserted paper to slide up and out of the slot.

Figure 15:
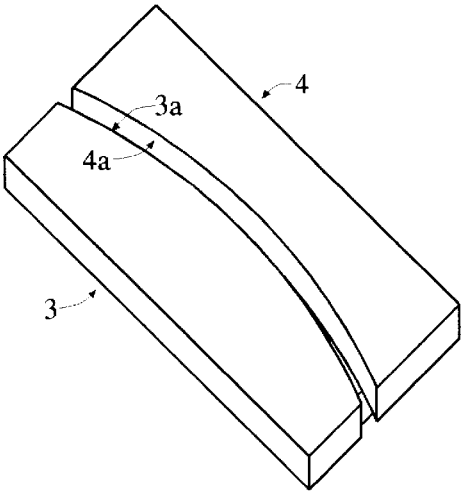
FIG. 15 is a perspective view of the third preferred embodiment of the document stand.
Figure 16:
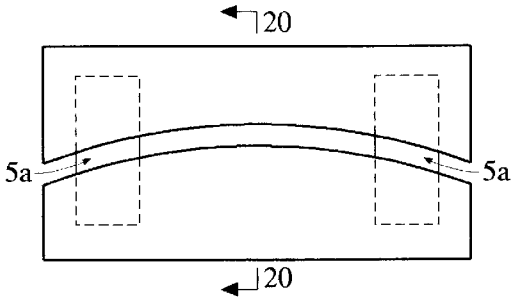
FIG. 16 is a top view of the third preferred embodiment of the document stand.
Figure 17:
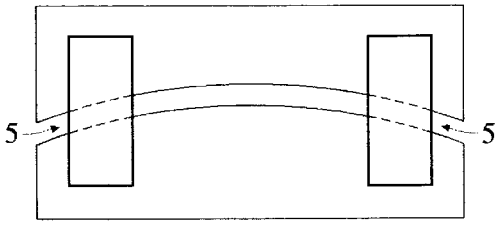
FIG. 17 is a bottom view of the third preferred embodiment of the document stand.
Figure 21:
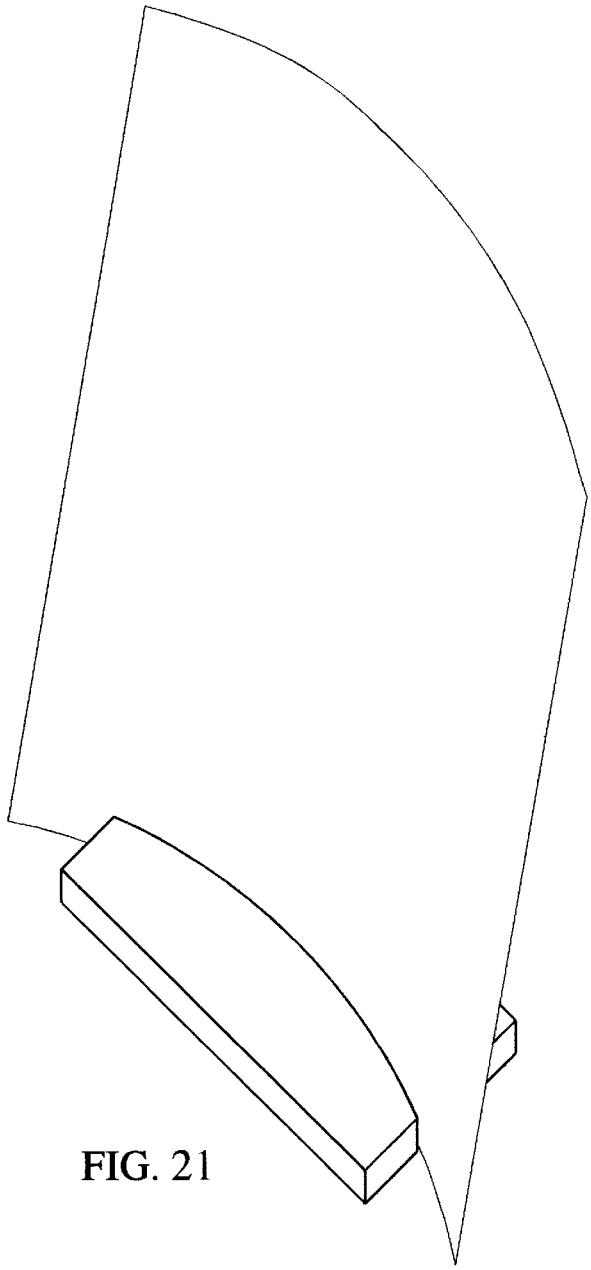
FIG. 21 is a perspective view with paper inserted, of the third preferred embodiment of the document stand.
Figure 18:
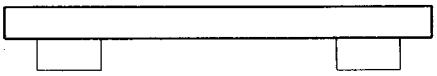
FIG. 18 is a front elevation of the third preferred embodiment of the document stand.
Figure 19:
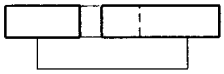
FIG. 19 is a side elevation of the third preferred embodiment of the document stand.
Figure 20:
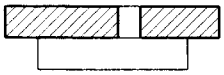
FIG. 20 is a section view of the third preferred embodiment of the document stand.

Referring to FIG. 15 through FIG. 21, the third preferred embodiment of the document stand is illustrated. The document stand is comprised of top-front component 3, top-rear component 4 and two base components 5. The sheet support mechanism is created through slot inner face 3*a*, slot outer face 4*a*, and slot lower face 5*a*. Slot inner face 3*a* and slot outer face 4*a* take on a similarly gently curved form in this embodiment. Slot lower face 5*a* takes the form of two separate supports on either side of a central portion of the slot. The central portion of the slot has an open bottom.

The bottom edge of the paper is flexed as required to fit into and conform to the bent shape of the device's slot. The placement of the paper will be such that the top tilts away from the viewer slightly. The paper will then be braced and held in place in a semi-rigid form that allows it to remain stable and hold its shape in this inclined position. The new shape and orientation of the inserted paper causes the central portion of the bottom edge of the paper to lie vertically beneath the level of the paper. This bottom edge of the inserted paper will abut slot lower face 5*a* at two points, one on either side of the center. This effectively creates a two point support for the inserted paper from which the center portion of the lower edge of the paper may hang freely. The two base components 5 serve to attach top-front component 3 to top-rear component 4, and to create slot lower face 5*a* while raising it sufficiently to allow the center of the bottom edge of the inserted paper to hang freely.

There will be a tendency for the document stand to tilt backwards due to the cantilevering of the paper beyond the rear most point of contact of base components 5 against the horizontal surface on which they sit. The weight of the materials chosen for all components therefore must be sufficient to counterbalance this tendency. The texture of slot inner face 3*a* and slot outer face 4*a* must create sufficient friction to offset the tendency of the base of the inserted paper to slide up and out of the slot.

Figure 22:
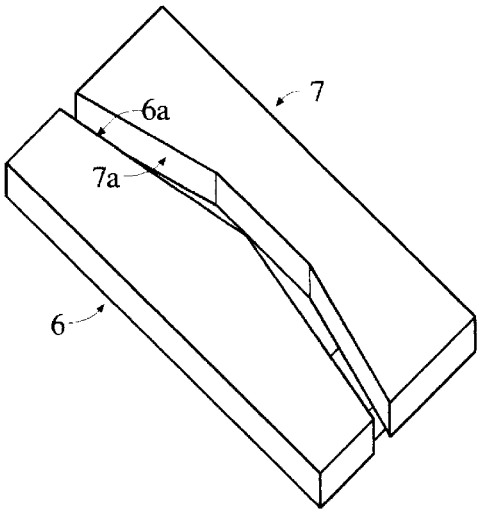
FIG. 22 is a perspective view of the fourth preferred embodiment of the document stand.
Figure 23:
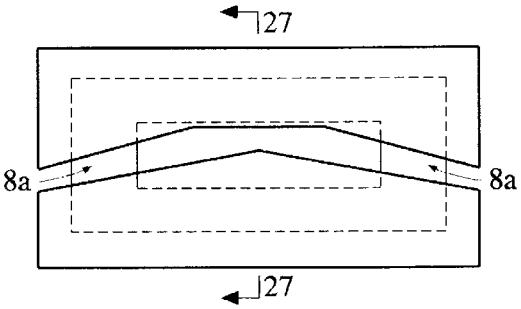
FIG. 23 is a top view of the fourth preferred embodiment of the document stand.
Figure 24:
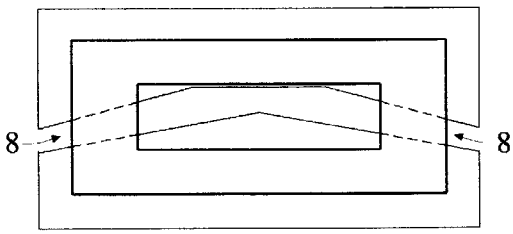
FIG. 24 is a bottom view of the fourth preferred embodiment of the document stand.
Figure 28:
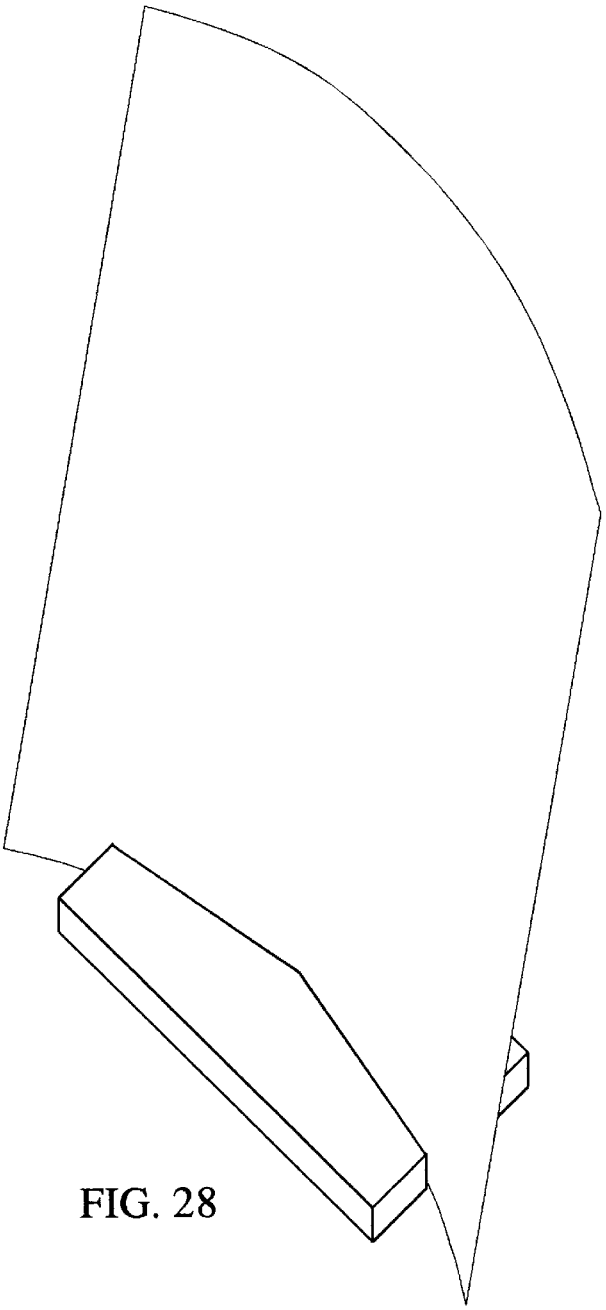
FIG. 28 is a perspective view with paper inserted, of the fourth preferred embodiment of the document stand.
Figure 25:
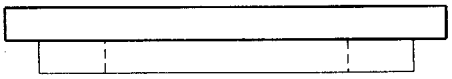
FIG. 25 is a front elevation of the fourth preferred embodiment of the document stand.
Figure 26:
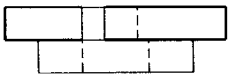
FIG. 26 is a side elevation of the fourth preferred embodiment of the document stand.
Figure 27:
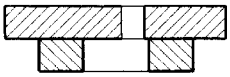
FIG. 27 is a section view of the fourth preferred embodiment of the document stand.

Referring to FIG. 22 through FIG. 28, the fourth preferred embodiment of the document stand is illustrated. The document stand is comprised of top-front component 6, top-rear component 7 and base component 8. The sheet support mechanism is created through slot inner face 6*a*, slot outer face 7*a*, and slot lower face 8*a*. Slot inner face 6*a* and slot outer face 7*a* take on slightly different faceted forms in this embodiment. Though base component 8 is shown as a single element, slot lower face 8*a* functions as two separate supports on either side of a central portion of the slot. The central portion of the slot has an open bottom.

The bottom edge of the paper is flexed as required to fit into and conform to the bent shape of the device's slot. The placement of the paper will be such that the top tilts away from the viewer slightly. The paper will then be braced and held in place in a semi-rigid form that allows it to remain stable and hold its shape in this inclined position. The new shape and orientation of the inserted paper causes the central portion of the bottom edge of the paper to lie vertically beneath the level of the bottom corners of the paper. This bottom edge of the inserted paper will abut slot lower face 8*a* at two points, one on either side of the center. This effectively creates a two point support for the inserted paper from which the center portion of the lower edge of the paper may hang freely. The base component 8 serves to attach top-front component 6 to top-rear component 7, and to create slot lower face 8*a* while raising it sufficiently to allow the center of the bottom edge of the inserted paper to hang freely.

There will be a tendency for the document stand to tilt backwards due to the cantilevering of the paper beyond the rear most point of contact of base component 8 against the horizontal surface on which it sits. The weight of the materials chosen for all components therefore must be sufficient to counterbalance this tendency. The texture of slot inner face 6*a* and slot outer face 7*a* must create sufficient friction to offset the tendency of the base of the inserted paper to slide up and out of the slot.

Figure 29:
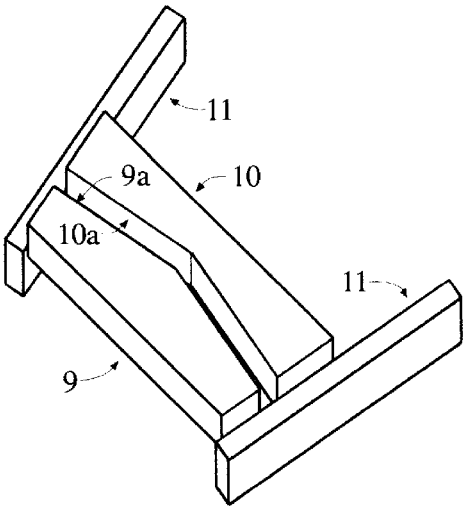
FIG. 29 is a perspective view of the fifth preferred embodiment of the document stand.
Figure 30:
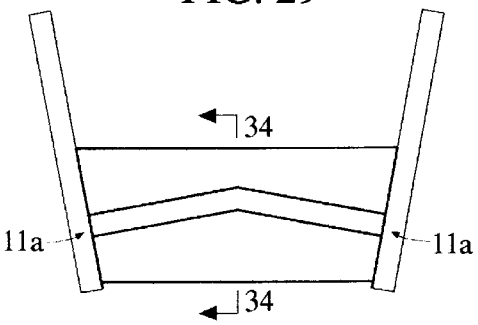
FIG. 30 is a top view of the fifth preferred embodiment of the document stand.
Figure 31:
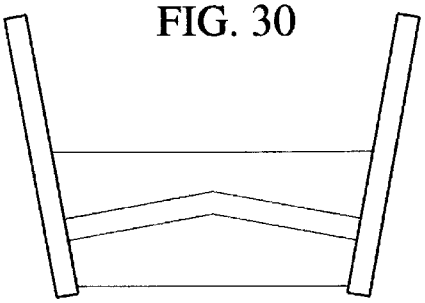
FIG. 31 is a bottom view of the fifth preferred embodiment of the document stand.
Figure 35:
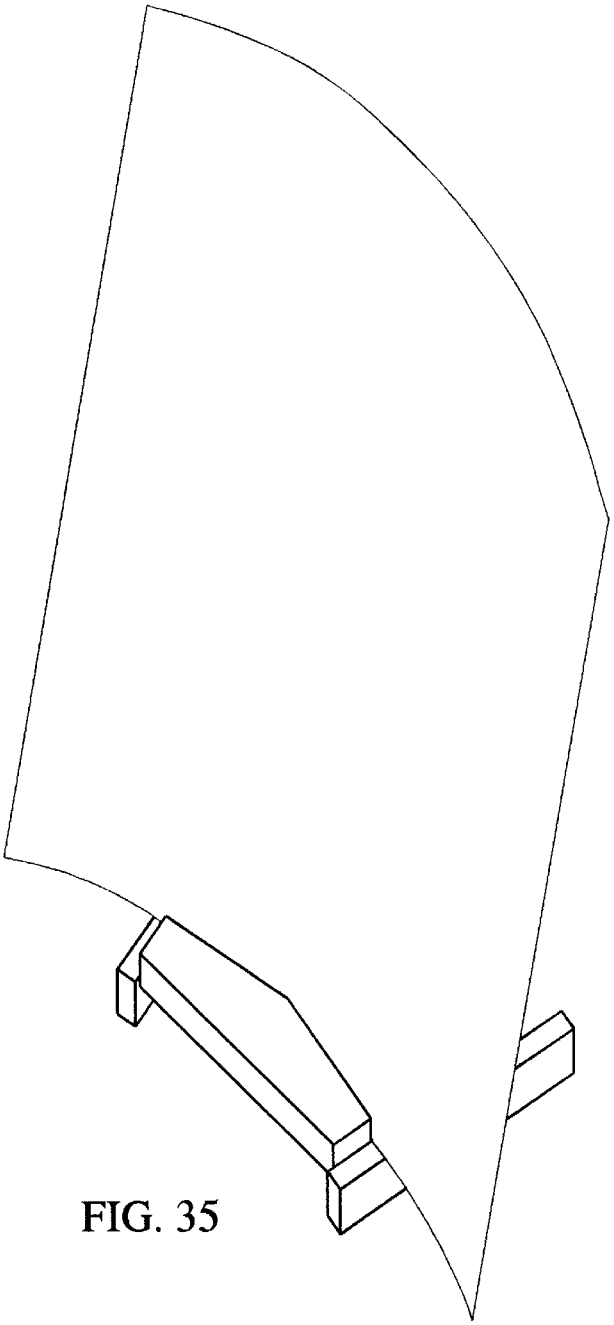
FIG. 35 is a perspective view with paper inserted, of the fifth preferred embodiment of the document stand.
Figure 32:
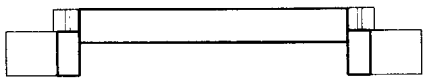
FIG. 32 is a front elevation of the fifth preferred embodiment of the document stand.
Figure 33:
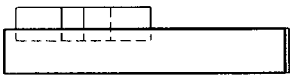
FIG. 33 is a side elevation of the fifth preferred embodiment of the document stand.
Figure 34:
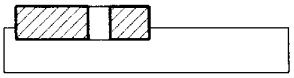
FIG. 34 is a section view of the fifth preferred embodiment of the document stand.

Referring to FIG. 29 through FIG. 35, the fifth preferred embodiment of the document stand is illustrated. The document stand is comprised of top-front component 9, top-rear component 10 and two base components 11. The sheet support mechanism is created through slot inner face 9*a*, slot outer face 10*a*, and slot lower face 11*a*. Slot inner face 9*a* and slot outer face 10*a* take on similar faceted forms in this embodiment. Slot lower face 11*a* takes the form of two separate supports on either side of a central portion of the slot. The central portion of the slot has an open bottom.

The bottom edge of the paper is flexed as required to fit into and conform to the bent shape of the device's slot. The placement of the paper will be such that the top tilts away from the viewer slightly. The paper will then be braced and held in place in a semi-rigid form that allows it to remain stable and hold its shape in this inclined position. The new shape and orientation of the inserted paper causes the central portion of the bottom edge of the paper to lie vertically beneath the level of the bottom corners of the paper. This bottom edge of the inserted paper will abut slot lower face 11*a* at two points, one on either side of the center. This effectively creates a two point support for the inserted paper from which the center portion of the lower edge of the paper may hang freely. The base components 11 serve to attach top-front component 9 to top-rear component 10, and to create slot lower face 11*a* while raising it sufficiently to allow the center of the bottom edge of the inserted paper to hang freely.

The extension of the two base components 11 beyond the vertical plane of the rear most extent of the inclined paper counterbalances any tendency of the document stand to tilt backwards due to the cantilevering of the paper. The texture of slot inner face 9*a* and slot outer face 10*a* must create sufficient friction to offset the tendency of the base of the inserted paper to slide up and out of the slot.

Figure 36:
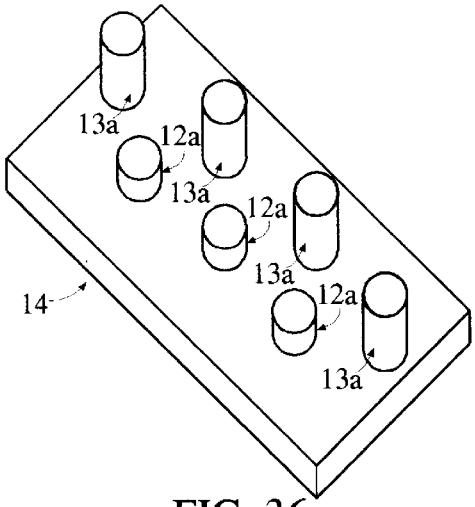
FIG. 36 is a perspective view of the sixth preferred embodiment of the document stand.
Figure 37:
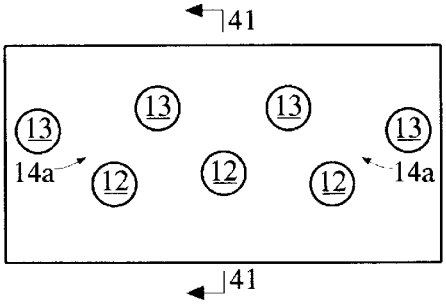
FIG. 37 is a top view of the sixth preferred embodiment of the document stand.
Figure 38:
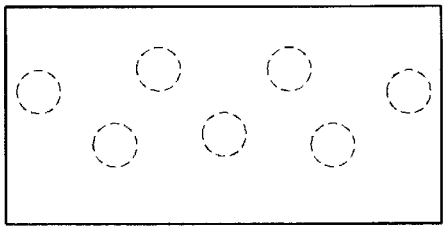
FIG. 38 is a bottom view of the sixth preferred embodiment of the document stand.
Figure 42:
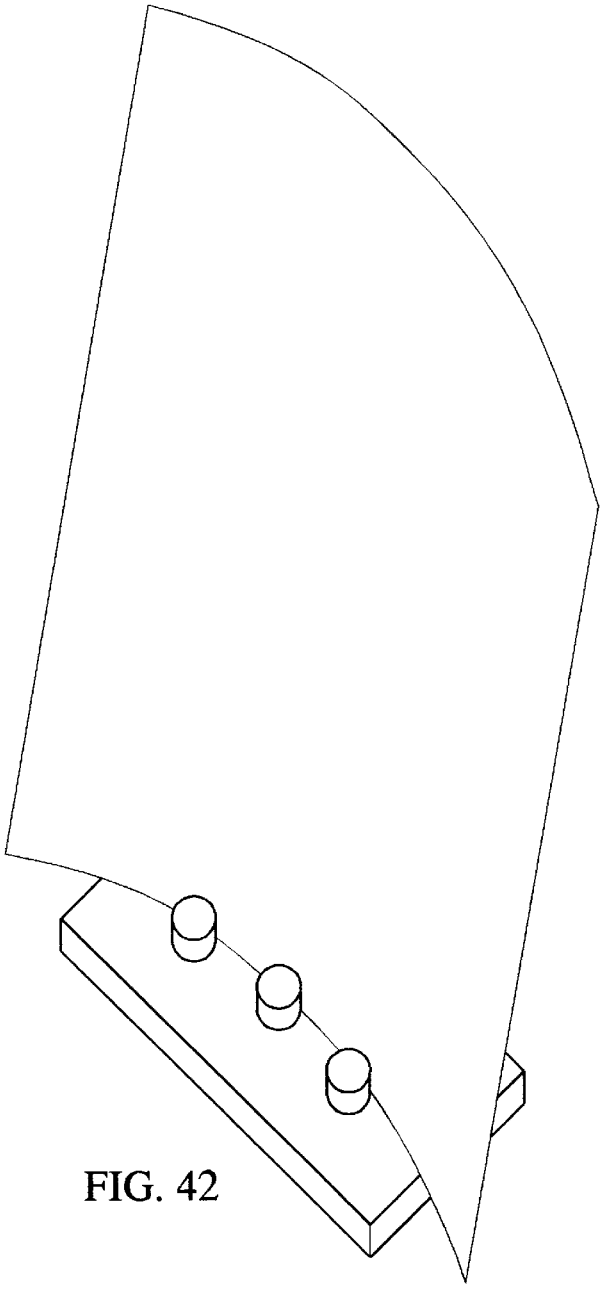
FIG. 42 is a perspective view with paper inserted, of the sixth preferred embodiment of the document stand.
Figure 39:
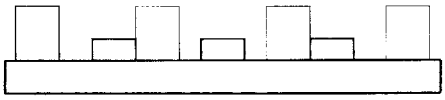
FIG. 39 is a front elevation of the sixth preferred embodiment of the document stand.
Figure 40:
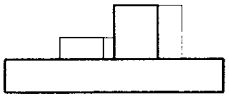
FIG. 40 is a side elevation of the sixth preferred embodiment of the document stand.
Figure 41:
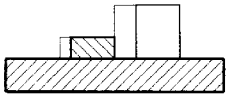
FIG. 41 is a section view of the sixth preferred embodiment of the document stand.

Referring to FIG. 36 through FIG. 42, the sixth preferred embodiment of the document stand is illustrated. The document stand is comprised of three top-front pegs 12, four top-rear pegs 13 and base component 14. The sheet support mechanism is created through slot inner face 12*a*, slot outer face 13*a*, and slot lower face 14*a*. Slot inner face 12*a* and slot outer face 13*a* are created through a series of pegs which delineate a bent slot through their configuration in this embodiment. Slot lower face 14*a* is a flat, horizontal, continuous surface.

The bottom edge of the paper is flexed as required to fit into and conform to the bent shape of the device's slot. The placement of the paper will be such that the top tilts away from the viewer slightly. The paper will then be braced and held in place in a semi-rigid form that allows it to remain stable and hold its shape in this inclined position. The new shape and orientation of the inserted paper causes the central portion of the bottom edge of the paper to lie vertically beneath the level of the bottom corners of the paper. This lowest portion of the inserted paper will abut slot lower face 14*a* at a single point only, preferably at a location near the center of the bottom edge of the inserted paper.

There will be a tendency for the document stand to tilt backwards due to the cantilevering of the paper beyond the rear most point of contact of base component 14 against the horizontal surface on which it sits. The weight of the materials chosen for all components therefore must be sufficient to counterbalance this tendency. Alternately the underside of component 14 may anchored directly to the stable surface on which it sits. The texture of slot inner face 12*a* and slot outer face 13*a* must create sufficient friction to offset the tendency of the base of the inserted paper to slide up and out of the slot.

While there have been shown and described several preferred embodiments of the document stand, it is understood that changes in structure, materials, sizes, and shapes can be made by those skilled in the art without departing from the invention. The invention is defined in the following claims.

I claim:

1. A document stand to support single or multiple sheets of inserted paper (or other thin flexible sheet material) comprising:

a base for supporting the inserted paper in a substantially upright position, slightly concave and inclined from the vertical;

said base includes a curved or otherwise bent slot on an upper portion adapted to receive a bottom edge of the inserted paper;

said slot includes an inner slot face, an outer slot face and a lower slot face;

said slot includes effective points of contact to support the inserted paper in an inclined, curved and stable position;

the outer slot face consists of three or more effective points of contact which follow a roughly horizontal direction;

the inner slot face consists of three or more effective points of contact which follow a roughly horizontal direction;

the lower slot face consists of at least one and no more than two effective points of contact.

2. The stand as set forth in claim 1 wherein said one effective point of contact which lies along the lower slot face is located approximately along the vertical axis bisecting the center of the inserted paper.

3. The stand as set forth in claim 1 wherein said two effective points of contact which lie along the lower slot face are located on either side of the vertical axis bisecting the center of the inserted paper, wherein the bottom center portion of the inserted paper shall hang freely.

4. A document stand to support single or multiple sheets of inserted paper (or other thin flexible sheet material) comprising:

a base for supporting the inserted paper in a substantially upright position, slightly concave and inclined from the vertical;

said base includes a series of pegs protruding from the upper portion of the device;

said pegs are arranged such that they follow along the path of two separate arcs oriented in the same direction along an approximately horizontal plane;

said arcs are separated such that a narrow continuous band of space is created between them that can receive a bottom edge of the inserted paper;

said base includes one or more points of support for the inserted paper along the lower surface of this continuous band of space between the arcs;

said base includes three or more pegs which lie along each of the two arcs, and come into contact with and serve to brace the inserted paper, whereby the inserted paper shall be supported in an inclined, curved and stable position.

* * * * *